US010744420B2

(12) United States Patent
Sakai

(10) Patent No.: US 10,744,420 B2
(45) Date of Patent: Aug. 18, 2020

(54) DECORATIVE TOY FOR FUSIBLE TOY BEAD, AND FUSIBLE TOY BEAD SET

(71) Applicant: EPOCH COMPANY, LTD., Tokyo (JP)

(72) Inventor: Ryo Sakai, Chiba (JP)

(73) Assignee: EPOCH COMPANY, LTD., Tokyo (JP)

( * ) Notice: Subject to any disclaimer, the term of this patent is extended or adjusted under 35 U.S.C. 154(b) by 0 days.

(21) Appl. No.: 16/392,744

(22) Filed: Apr. 24, 2019

(65) Prior Publication Data

US 2019/0329144 A1 Oct. 31, 2019

(30) Foreign Application Priority Data

Apr. 25, 2018 (JP) ..... 2018-083883

(51) Int. Cl.

| | |
|---|---|
| ***A63H 33/08*** | (2006.01) |
| ***B44C 3/12*** | (2006.01) |
| ***A63H 33/14*** | (2006.01) |
| *A63H 3/16* | (2006.01) |

(52) U.S. Cl.

CPC ..... *A63H 33/08* (2013.01); *A63H 33/14* (2013.01); *B44C 3/12* (2013.01); *A63H 3/16* (2013.01)

(58) Field of Classification Search

CPC ..... A44C 13/00; A63F 9/12; A63F 7/0088; A63F 2009/1224; A63F 9/08; A63F 9/0861; A63H 33/101; A63H 33/18; A63H 33/14; A63H 33/00; A63H 33/062; A63H 33/001; A63H 33/08; A63H 33/04; A63H 33/26; A63H 33/06; A63H 33/105; A63H 3/16; A63H 33/003; A63H 33/088; A63H 3/04; A63H 3/52; B44C 3/12

USPC .... 446/87, 97, 102, 118, 121, 127, 131, 137

See application file for complete search history.

(56) References Cited

U.S. PATENT DOCUMENTS

| | | | | | |
|---|---|---|---|---|---|
| 2,406,759 | A * | 9/1946 | Glukes | A63H 33/065 | 446/127 |
| 2,990,640 | A * | 7/1961 | Burnbaum | A44C 11/002 | 59/80 |
| 3,947,992 | A * | 4/1976 | Lemelson | A63H 33/22 | 446/87 |
| 5,653,621 | A * | 8/1997 | Yao | A63H 33/082 | 446/127 |
| 5,704,789 | A * | 1/1998 | Yang | B44C 3/123 | 221/185 |

(Continued)

FOREIGN PATENT DOCUMENTS

| | | |
|---|---|---|
| GB | 2552898 A | 2/2018 |
| JP | S61-44699 A | 3/1986 |
| JP | 3131292 U | 4/2007 |

OTHER PUBLICATIONS

Search Report dated Oct. 14, 2019 in British Patent Application No. 1905781.9.

*Primary Examiner* — Nini F Legesse

(74) *Attorney, Agent, or Firm* — Faegre Drinker Biddle & Reath LLP

(57) ABSTRACT

A decorative toy for fusible toy bead includes a bead engagement portion. The bead engagement portion includes a protrusion, a groove or a hole having a width dimension which is set in accordance with a maximum dimension of fusible toy beads, and is configured to be engageable with an aggregation of the fusible toy beads.

7 Claims, 10 Drawing Sheets

(56) References Cited

U.S. PATENT DOCUMENTS

| | | | | |
|---|---|---|---|---|
| 6,991,141 | B2 * | 1/2006 | Ciko | A44C 11/002 223/48 |
| 9,320,330 | B2 * | 4/2016 | Cooke | A63F 9/06 |
| 9,956,495 | B2 * | 5/2018 | Kamiyama | A63F 9/06 |
| 2002/0102905 | A1 * | 8/2002 | Tseng | A63H 33/001 446/131 |
| 2007/0077326 | A1 * | 4/2007 | Smith | B29C 43/52 425/407 |
| 2008/0003917 | A1 * | 1/2008 | Norman | A63F 9/08 446/97 |
| 2013/0183881 | A1 * | 7/2013 | Kamiyama | B44C 3/12 446/87 |
| 2016/0271509 | A1 | 9/2016 | Arboleda | |
| 2017/0246551 | A1 * | 8/2017 | Kamiyama | A63F 9/06 |
| 2018/0043276 | A1 * | 2/2018 | Sakai | A63H 33/14 |

* cited by examiner

DECORATIVE TOY FOR FUSIBLE TOY BEAD, AND FUSIBLE TOY BEAD SET

CROSS-REFERENCES TO RELATED APPLICATIONS

This application is based on and claims priority from Japanese Patent Application No. 2018-083883 filed on Apr. 25, 2018, the entire contents of which are incorporated herein by reference.

FIELD

One or more embodiments of the present invention relate to a decorative toy for fusible toy bead and a fusible toy bead set.

BACKGROUND

There has been fusible toy beads that use granular beads formed of a water-soluble resin. JP-U-3131292 discloses a toy bead set including: a holding tray having a plurality of concave portions such that fusible toy beads are placed therein; a base tray; and a sheet to be inserted between the holding tray and the base tray. Here, the sheet has a pattern illustrated thereon, and the user can create various shapes of fusible toy bead aggregations by placing fusible toy beads on the holding tray in accordance with this pattern.

The fusible toy beads are formed, for example, by compounding polyvinyl alcohol into a resin, mixing them and forming them into granules. Then, after a plurality of fusible toy beads are placed on the holding tray, water is supplied to the fusible toy beads by an atomizer or the like so as to be wet, whereby the fusible toy beads are molten. Then, after being left for a predetermined time and dried, the molten resin hardens, so that the fusible toy beads unite together. In this way, children who are main users can enjoy creating aggregations of fusible toy beads of desired patterns.

The created aggregations of fusible toy beads can also be used as ornaments. In this case, as disclosed in JP-A-561-044699, an adhesive sheet may be attached to the object to be decorated so that aggregations of fusible toy beads can be attached to this adhesive sheet.

SUMMARY

When the created aggregations of fusible toy beads are attached and detached a plurality of times to the object to be decorated to which the adhesive sheet is attached, the adhesive power of the adhesive sheet is weakened, so that only several times of use can make it impossible to play with them. For this reason, it is considered to enhance the adhesive power; however, a strong adhesive force makes detachment difficult for small children, which can make it impossible to play with them enjoyably. Moreover, although it is possible to create parts with aggregations of fusible toy beads and assemble them to create an object, for small children, it is difficult to create a large object or a complicated object and therefore, ways of playing are limited.

An object of one or more embodiments of the present invention is to provide a decorative toy for fusible toy bead to and from which children can easily attach and detach aggregations of fusible toy beads, and a fusible toy bead set provided with the decorative toy for fusible toy bead.

In one aspect of the present invention, there is provided a decorative toy for fusible toy bead including: a bead engagement portion including a protrusion, a groove or a hole having a width dimension which is set in accordance with a maximum dimension of fusible toy beads, and configured to be engageable with an aggregation of the fusible toy beads.

In another aspect of the present invention, there is provided a fusible toy bead set including: a plurality of fusible toy beads; and the decorative toy for fusible toy bead described above.

According to aspects of the present invention, it is possible to provide a decorative toy for fusible toy bead to and from which children can easily attach and detach aggregations of fusible toy beads, and a fusible toy bead set provided with the decorative toy for fusible toy bead.

BRIEF DESCRIPTION OF DRAWINGS

FIG. 1A is a perspective view viewed from the front side, and FIG. 1B is a perspective view viewed from the rear side.

FIG. 2A shows a spherical fusible toy bead.

FIG. 3A is a view showing an example in the image of a tiger, and FIG. 3B is an example in the image of a lion.

FIG. 4A is a perspective view viewed from the front, and FIG. 4B is a perspective view viewed from the rear.

FIG. 6A is a perspective view, and FIG. 6B is a view showing an example in which aggregations of the fusible toy beads are attached.

DETAILED DESCRIPTION

Figure 1A:
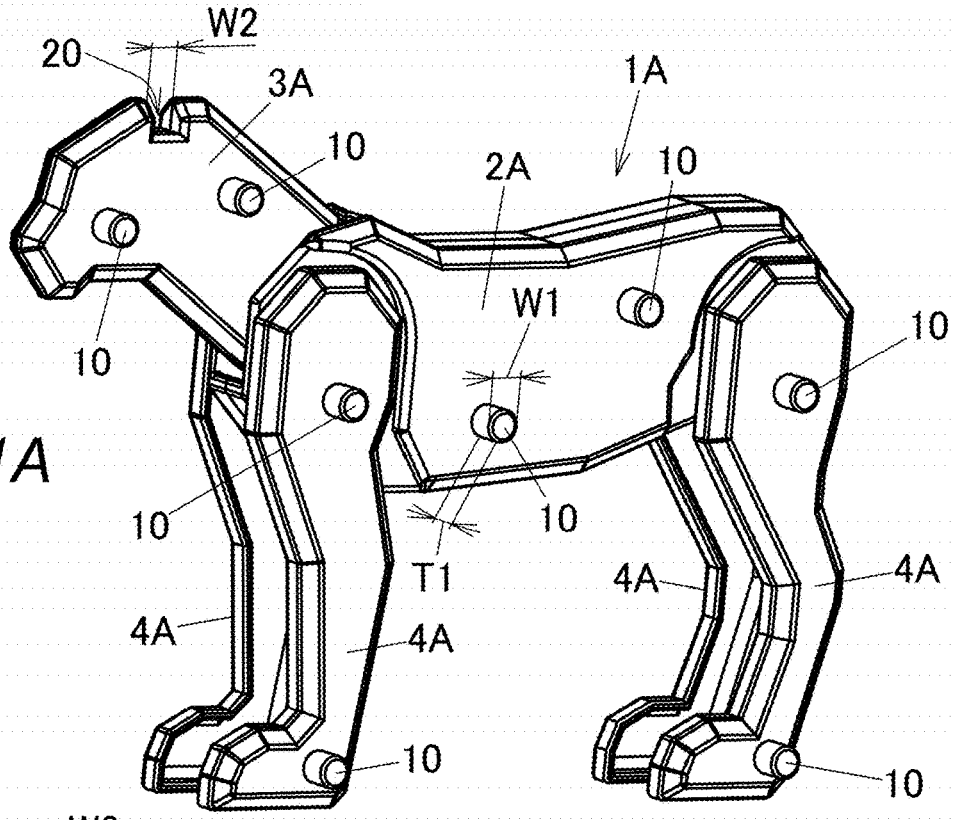
FIGS. 1A and 1B are views showing a decorative toy for fusible toy bead imitating an animal according to an embodiment of the present invention.
Figure 1B:
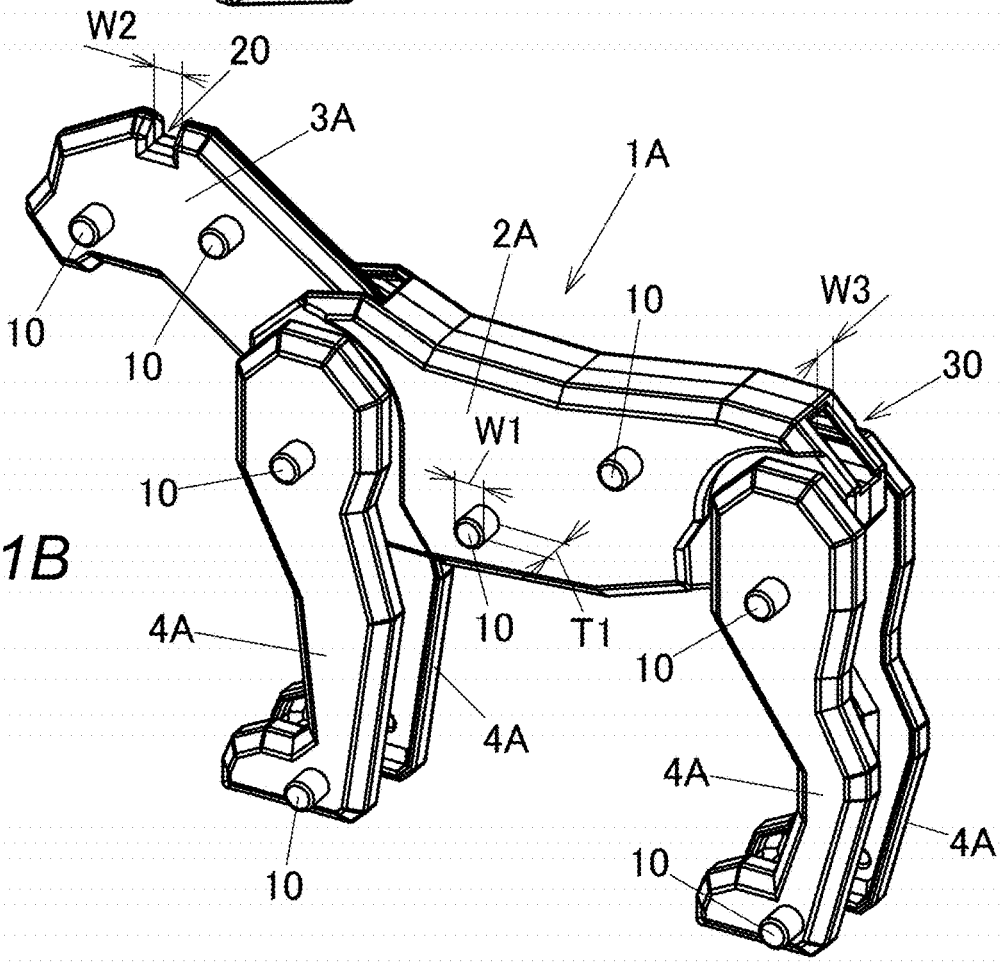

Next, an embodiment of the present invention will be described based on the drawings. FIGS. 1A and 1B show a decorative toy 1A for fusible toy bead imitating an animal. The decorative toy 1A has a shape imitating a quadrupedal walking animal such as a tiger or a lion. The decorative toy 1A is provided with a body portion 2A, a head portion 3A and four leg portions 4A. The body portion 2A is formed so as to be elongated from front to back. The head portion 3A which is formed in the shape of a plate is connected to the body portion 2A in such a manner as to be inserted into the forked end portion of the body portion 2A. To connect the head portion 3A to the body portion 2A, although not shown, a shaft portion formed on the body portion 2A is inserted into a bearing of the head portion 3A and the head portion 3A is connected to the body portion 2A so as to be pivotable about the shaft portion. To the axial connection between the body portion 2A and the head portion 3A, a predetermined sliding resistance is applied. Therefore, the head portion 3A can be set in an arbitrary pivot position. The leg portions 4A connected to the front end side surfaces and rear end side surfaces of the body portion 2A, respectively, are also axially connected to the body portion 2A so as to be pivotable, and can be set in an arbitrary pivot position.

On both side surfaces of each of the body portion 2A, the head portion 3A and the leg portions 4A, a plurality of bead engagement portions 10 in the shape of a protrusion are provided. Although only one side surface of each is shown in FIGS. 1A and 1B, bead engagement portions 10 are also formed in the same positions on the other side surface of each.

Figure 2A:
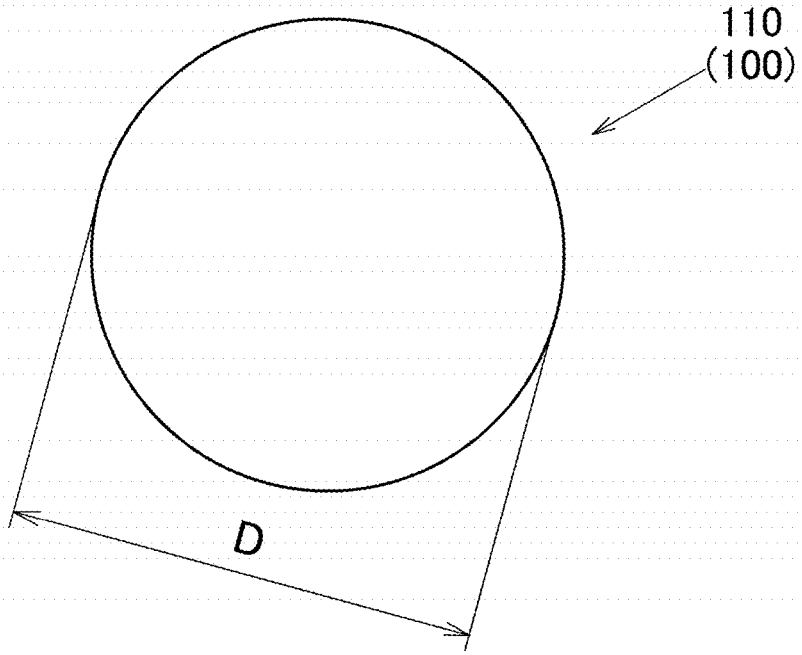
FIGS. 2A an 2B are views showing an example of the fusible toy beads for creating an aggregation of the fusible toy beads to be attached to the decorative toy for fusible toy bead according to the embodiment of the present invention.
Figure 2B:
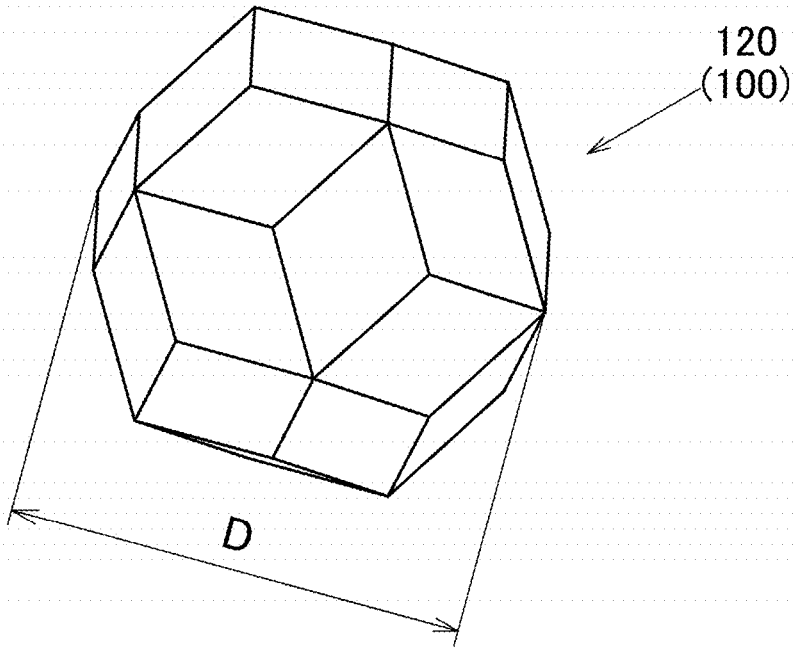
FIG. 2B shows a polyhedral fusible toy bead.

The width dimension W1 as the diameter of the bead engagement portions 10 which are made cylindrical is formed in accordance with the maximum dimension D of a fusible toy bead 100 shown in FIGS. 2A and 2B. In other words, the width dimension W1 and the maximum dimension D are formed so as to be substantially the same. Here, the fusible toy bead 100 is formed of a resin which is a water-soluble material. Specifically, it is formed by compounding polyvinyl alcohol into the resin and mixing them. Moreover, the resin forming the fusible toy bead 100 may be formed by appropriately selecting a transparent material or a material having translucency, or an opaque material. Regarding the maximum dimension of the fusible toy bead 100, in the case of a spherical fusible toy bead 110 illustrated in FIG. 2A, the maximum dimension D is the diameter, whereas in the case of a polyhedral fusible toy bead 120 illustrated in FIG. 2B, the maximum dimension D is the maximum value of the apex-to-apex distance. Further, the height dimension T1 of the bead engagement portions 10 is formed in accordance with the maximum dimension D of the fusible toy bead 100. In other words, the height dimension T1 and the maximum dimension D are formed so as to be substantially the same.

There are cases where the maximum dimension D of the spherical fusible toy bead 110 shown in FIG. 2A and the maximum dimension D of the polyhedral fusible toy bead 120 shown in FIG. 2B are set so as to be different from each other. Specifically, for example, there are cases where the maximum dimension D of the spherical fusible toy bead 110 is 5 mm and the maximum dimension D of the polyhedral fusible toy bead 120 is 6 mm, and the width dimension W1 and the height dimension T1 at this time are only necessarily set in a range of 5 mm to 6 mm. That is, it is necessary only that the width dimension W1 and the height dimension T1 (ditto for width dimensions W2 to W9 described later) approximately coincide with the maximum dimension D of the fusible toy bead 100 (110, 120).

Moreover, as shown in FIGS. 1A and 1B, at the head top portion of the head portion 3A, a groove-form bead engagement portion 20 parallel to the normal with respect to the side surfaces of the head portion 3A is formed. The width dimension W2 which is the groove width dimension of the bead engagement portion 20 is formed in accordance with the maximum dimension D of the fusible toy bead 100. In other words, the width dimension W2 and the maximum dimension D are formed so as to be substantially the same. Further, as shown in FIG. 1B, at the rear end of the body portion 2A, a bead engagement portion 30 formed in the shape of a rectangular (oblong) hole is formed. The width dimension W3 which is made the dimension in the width direction of the bead engagement portion 30 in the shape of a rectangular hole is formed in accordance with the maximum dimension D of the fusible toy bead 100. In other words, the width dimension W3 and the maximum dimension D are formed so as to be substantially the same.

With the bead engagement portions 10, 20 and 30 formed in the shapes of a protrusion, a groove and a hole, respectively, separately created aggregations of fusible toy beads 100 are engaged. The aggregations of the fusible toy beads 100 are formed by using a plurality of spherical fusible toy beads 110 illustrated in FIG. 2A and a plurality of polyhedral fusible toy beads 120 illustrated in FIG. 2B. Describing an outline of the formation of an aggregation of the fusible toy beads 100, first, a plurality of fusible toy beads 100 are disposed so as to be in an arbitrary shape on a tray having a plurality of concave portions adapted to the fusible toy beads 100. Then, after water is sprayed to the fusible toy beads 100 on the tray, the fusible toy beads 100 are dried and hardened. Thus, an aggregation of the fusible toy beads 100 can be formed.

Figure 3A:
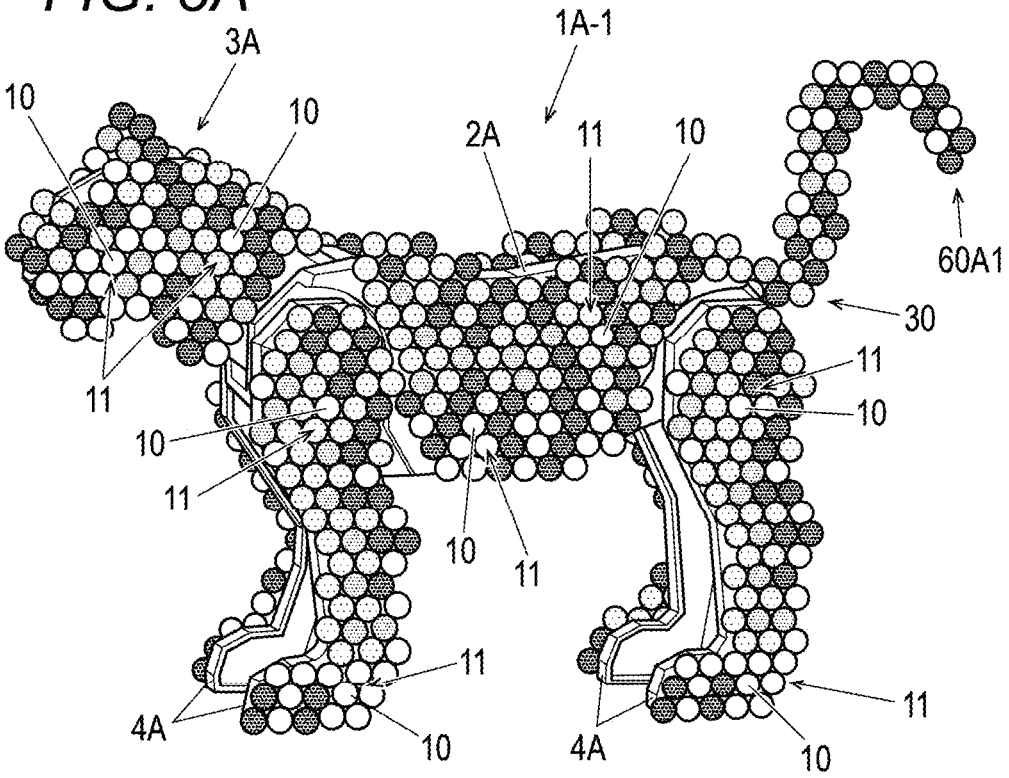
FIGS. 3A and 3B are views showing an example in which aggregations of the fusible toy beads are attached to the decorative toy for fusible toy bead imitating an animal according to the embodiment of the present invention.

The aggregations of the fusible toy beads 100 may be formed in a shape of a plane to have void portions 11 (see FIGS. 3A and 3B), and each void portion 11 is formed such that one fusible toy bead 100 is missing in the aggregation of the fusible toy beads 100. With this configuration, the protrusion-form bead engagement portions 10 can be inserted in and engaged with the void portions 11. For example, as shown in the example of FIG. 3A in the image of a tiger, the bead engagement portions 10 of the body portion 2A, the head portion 3A and the leg portions 4A are inserted and engaged in the void portions 11 of the aggregations of the fusible toy beads 100 formed in accordance with the body portion 2A, the head portion 3A and the leg portions 4A, respectively, whereby the aggregations of the fusible toy beads 100 formed in accordance with the body portion 2A, the head portion 3A and the leg portions 4A can be attached to the decorative toy 1A.

Figure 3B:
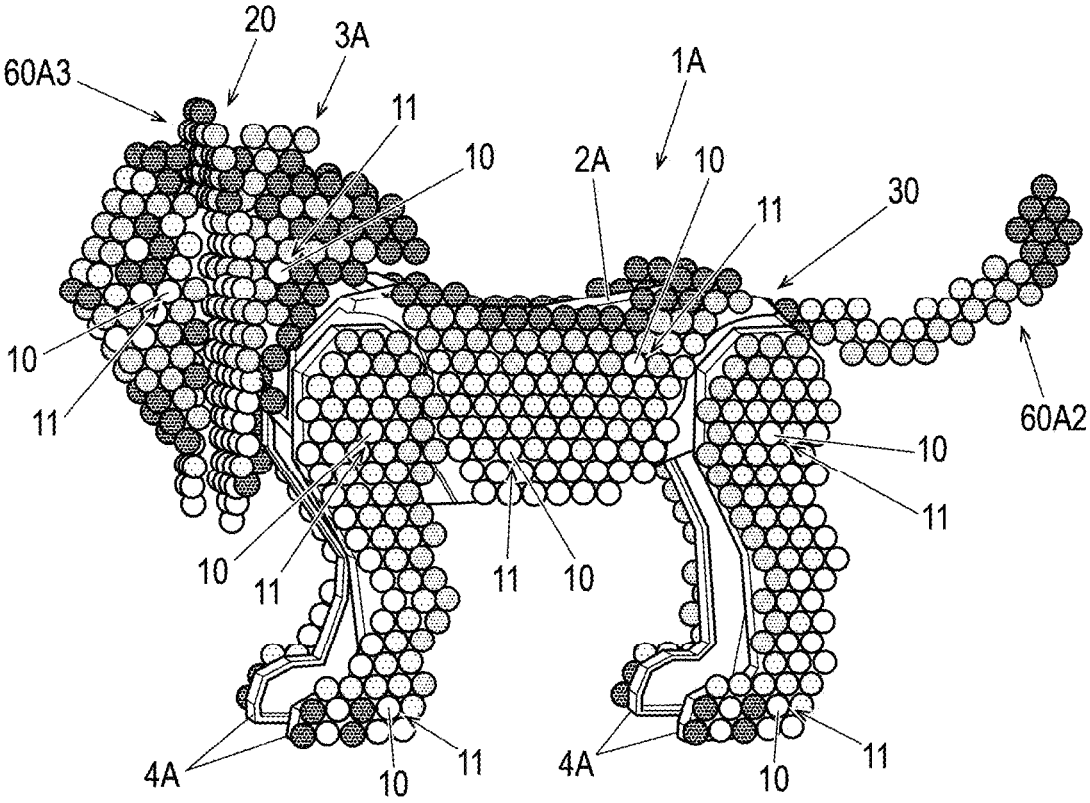

Moreover, aggregations 60A1 and 60A2 of the fusible toy beads 100 formed in the shape of an animal's tail by two-dimensionally disposing the fusible toy beads 100 can be engaged by partly inserting the aggregations 60A1 and 60A2 of the fusible toy beads 100 into the hole-form bead engagement portion 30. Likewise, an aggregation 60A3 of the fusible toy beads 100 imitating a lion's mane by two-dimensionally disposing the fusible toy beads 100 which aggregation 60A3 is shown in the example of FIG. 3B in the image of a lion can be engaged by partly inserting the aggregation 60A3 of the fusible toy beads 100 into the groove-form bead engagement portion 20.

Figure 4A:
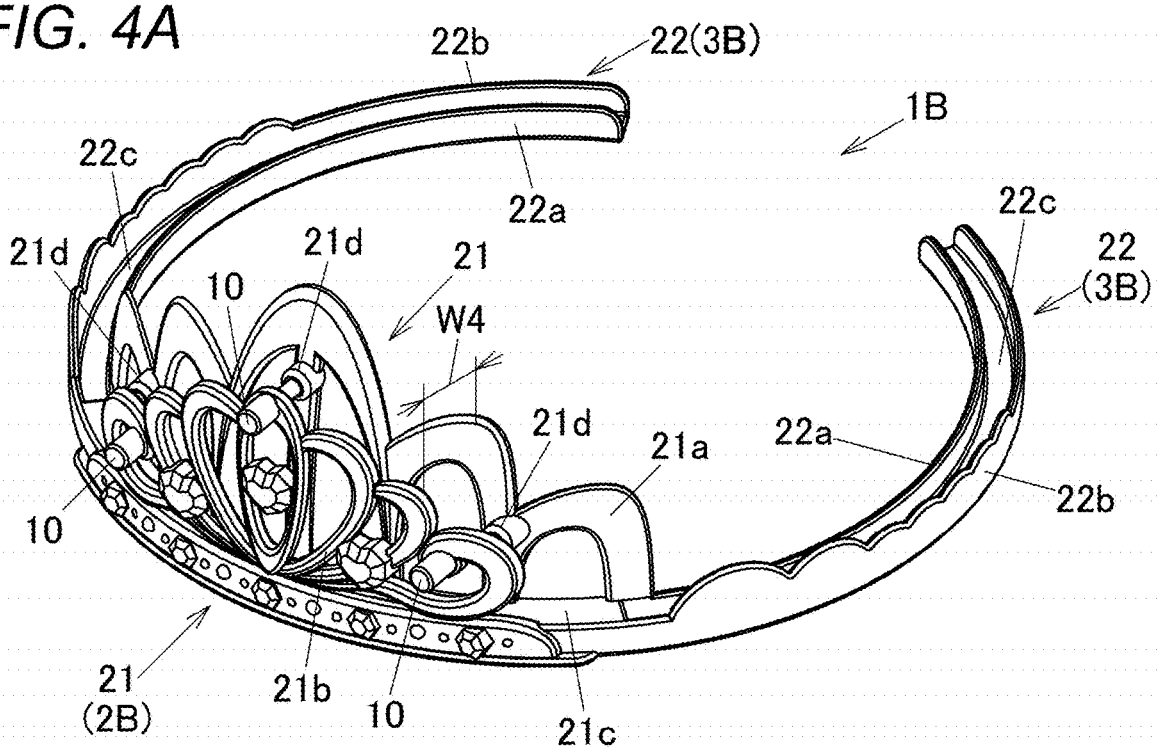
FIGS. 4A and 4B are views showing a decorative toy for fusible toy bead imitating a tiara according to the embodiment of the present invention.
Figure 4B:
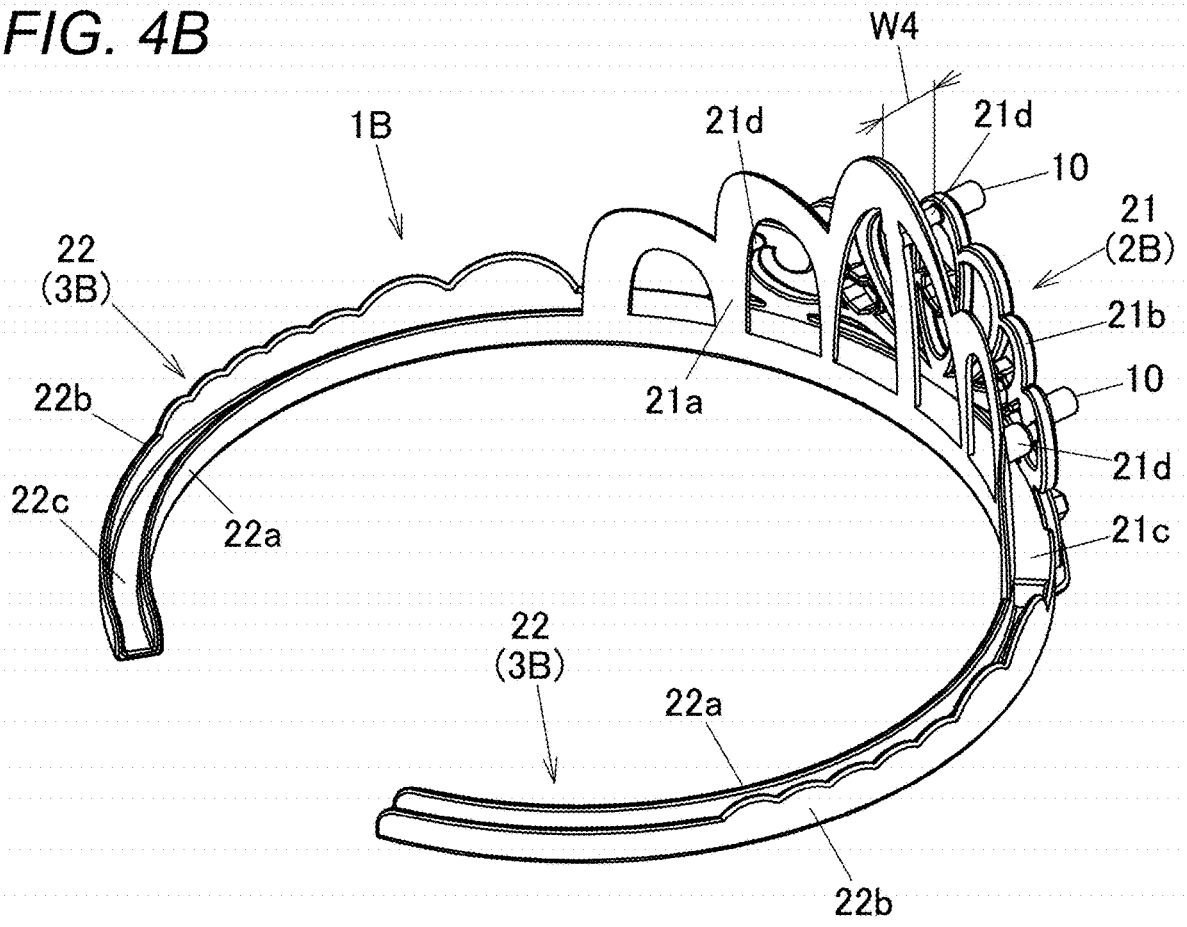

Next, a decorative toy 1B for fusible toy bead imitating a tiara as an ornament is shown in FIGS. 4A and 4B. The decorative toy 1B is provided with a bead engagement portion 21 as an ornament portion 2B disposed in front and a bead engagement portion 22 as a support portion 3B formed in the shape of an arc so as to be attached to the head top portion while supporting the ornament portion 2B on the right and left sides.

The bead engagement portion 21 (the ornament portion 2B) is provided with two plate-like members 21*a* and 21*b* having a decorative form and disposed so as to face each other with a predetermined interval therebetween. A bottom plate 21*c* is formed in a lower part between the two plate-like members 21*a* and 21*b*. By the two plate-like members 21*a* and 21*b* and the bottom plate 21*c*, the bead engagement portion 21 is formed in the shape of a groove. The width dimension W4 which is the groove width of the bead engagement portion 21 is made substantially the same as the maximum dimension D in accordance with the maximum dimension D of the fusible toy bead 100 shown in FIGS. 2A and 2B. The two plate-like members 21*a* and 21*b* are formed so as to be different in height dimension from each other.

Between the plate-like members 21*a* and 21*b* of the bead engagement portion 21, reinforcement support portions 21*d* are formed in such a manner that bosses protruding from the rear surface of the plate-like member 21*b* on the front side are inserted into hole portions provided so as to correspond to the bosses on the front surface of the plate-like member 21*a* on the rear side. This reinforces the support of the plate-like members 21*a* and 21*b* that are large in height. Moreover, on the front surface of the plate-like member 21*b*, a plurality of cylindrical protrusion-form bead engagement portions 10 similar to the above-described ones are formed.

The bead engagement portion 22 (the support portion 3B) is formed in the shape of a groove by inside and outside plate-like members 22*a* and 22*b* and a bottom plate 22*c* formed at the lower end between the plate-like members 22*a* and 22*b*. In front of the outside plate-like member 22*b*, a mound-shaped ornament that is small in height is formed, and at that part, the inside and outside plate-like members 22*a* and 22*b* are different in height from each other. The inside and outside plate-like members 22*a* and 22*b* are connected to the plate-like members 21*a* and 21*b* of the bead engagement portion 21, respectively. Therefore, the groove width (width dimension) of the bead engagement portion 22 is made the same as the width dimension W4 which is the groove width at the bead engagement portion 21 described previously. Although not shown, space is formed below the bottom plate 21*c* of the bead engagement portion 21, and is formed in the shape of a groove by the plate-like members 21*a* and 21*b* and the bottom plate 21*c*.

Figure 5:
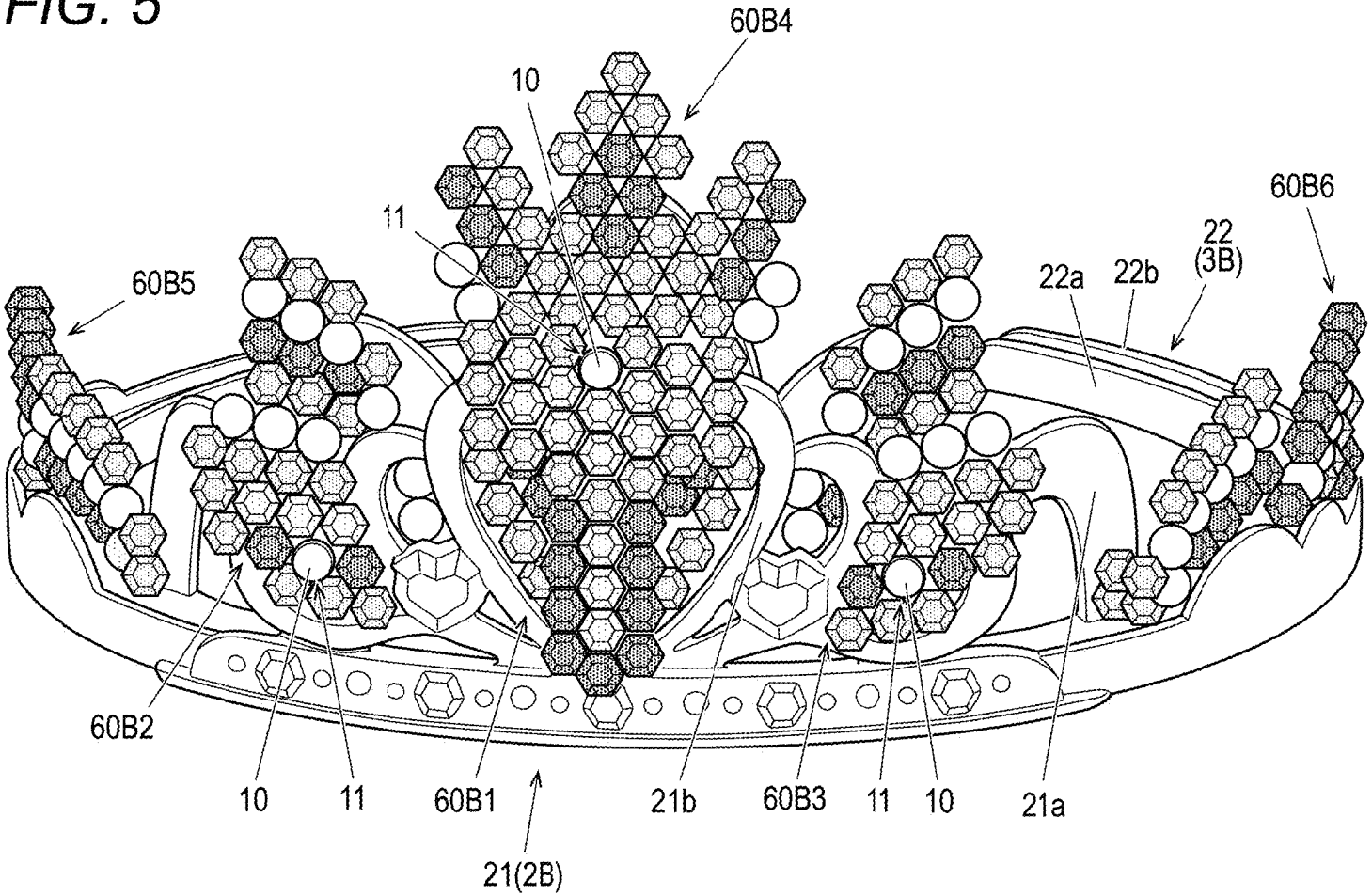
FIG. 5 is a view showing an example in which aggregations of the fusible toy beads are attached to the decorative toy for fusible toy bead imitating a tiara according to the embodiment of the present invention.

An example of attachment of aggregations of the fusible toy beads 100 to the decorative toy 1B is shown in FIG. 5. Similarly to the above description, aggregations 60B1, 60B2 and 60B3 of the fusible toy beads 100 formed in the shape of a plane so as to have the void portions 11 each coinciding with one fusible toy bead 100 can be attached to the decorative toy 1B by fitting the void portions to the protrusion-form bead engagement portions 10 so as to be engaged therewith. Moreover, aggregations 60B4, 60B5 and 60B6 of the fusible toy beads 100 formed in the shape of a plane are inserted into the groove-form bead engagement portions 21 and 22. At this time, since the plate-like members 21*a* and 21*b* and the plate-like members 22*a* and 22*b* are formed so as to be different in height from each other, the aggregations 60B4, 60B5 and 60B6 of the fusible toy beads 100 can be disposed so as to look nice while supporting the aggregations 60B4, 60B5 and 60B6 of the fusible toy beads 100 so as not to fall down.

Figure 6A:
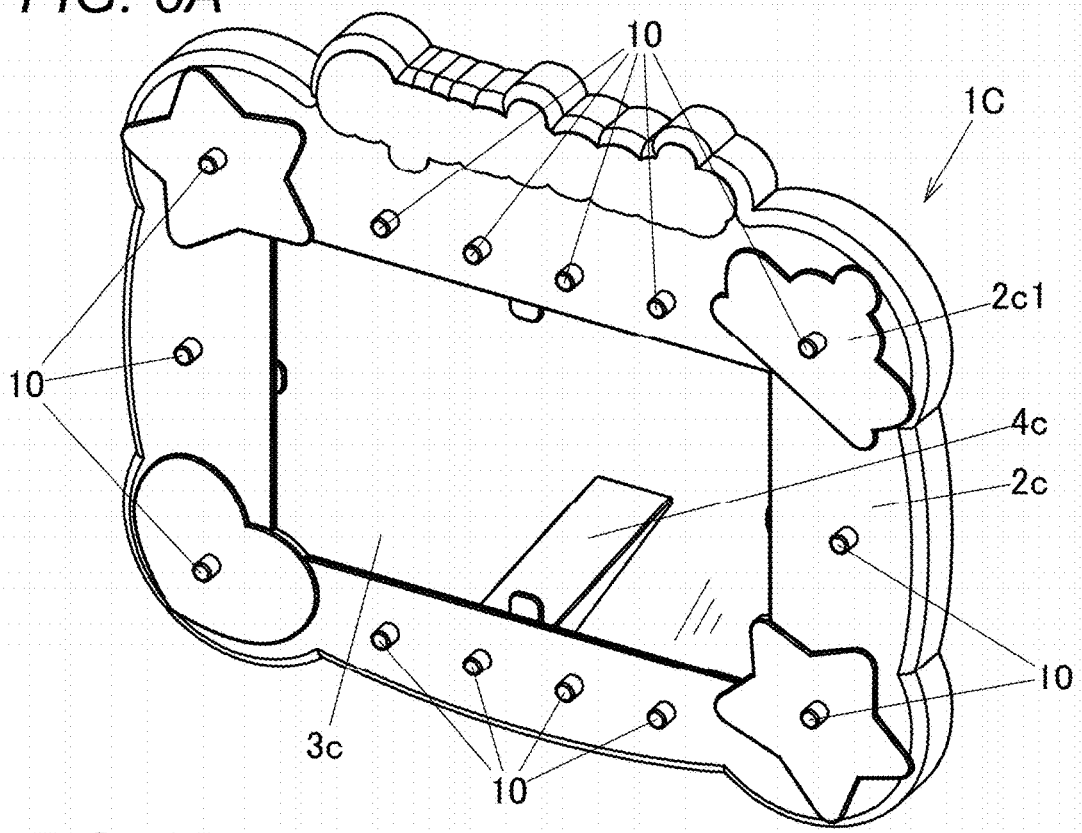
FIGS. 6A and 6B show a decorative toy for fusible toy bead as a photo frame according to the embodiment of the present invention.
Figure 6B:
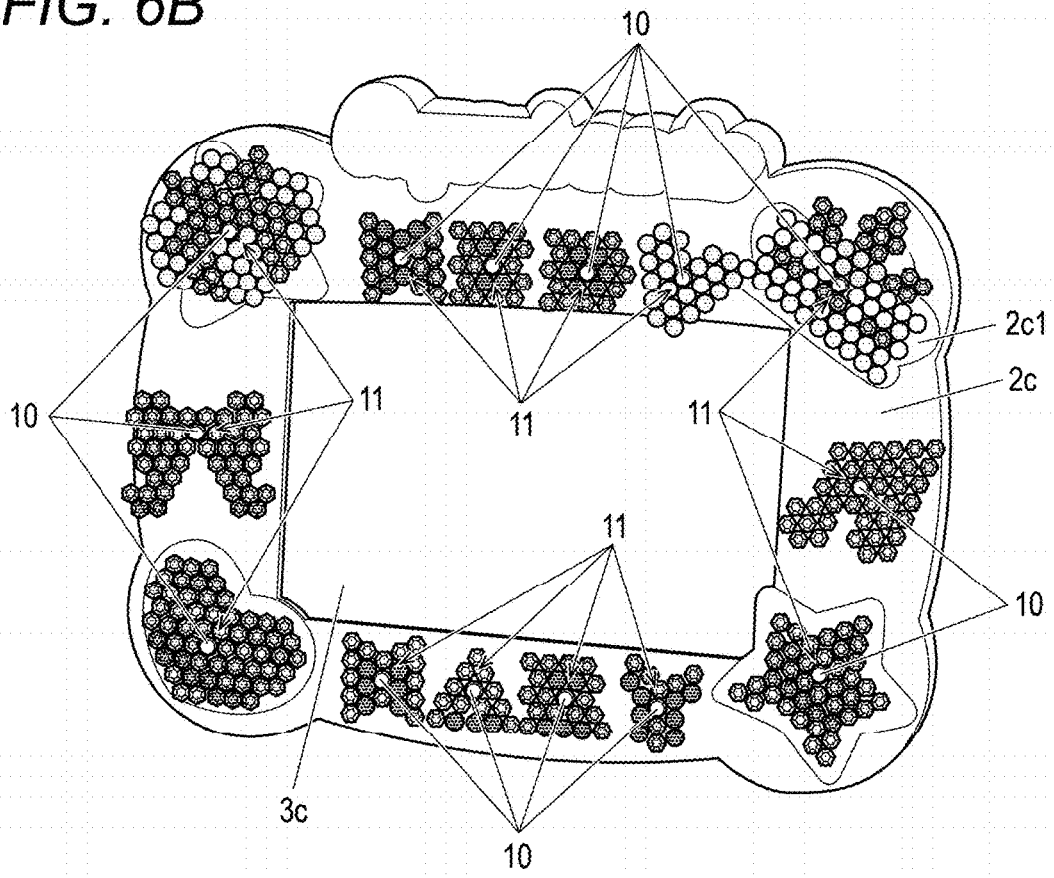

Next, a decorative toy 1C for fusible toy bead as an ornament as a photo frame is shown in FIG. 6A. On a body portion 2C in the shape of a rectangular frame, a transparent plate is disposed in the center as a photo locking portion 3C. From the lower rear surface of the body portion 2C, a leg portion 4C is extended so that the decorative toy 1C can be placed upright on a desk or the like. On the surface of the body portion 2C, a plurality of bead engagement portions 10 in the shape of a cylindrical protrusion are provided. On the surfaces of the four corners of the body portion 2C, decorative portions 2C1 in the shapes of a star, a heart and the like are formed. On each of the decorative portions 2C1, the bead engagement portion 10 is formed substantially at the center of each decorative portion 2C1. Similarly to the above description, aggregations of the fusible toy beads 100 formed in the shape of a plane so as to have void portions 11 each coinciding with one fusible toy bead 100 are separately created, and the void portions 11 are fitted to the bead engagement portions 10 as shown in FIG. 6B, whereby the aggregations of the fusible toy beads 100 can be attached to the surface of the body portion 2C.

Figure 7:
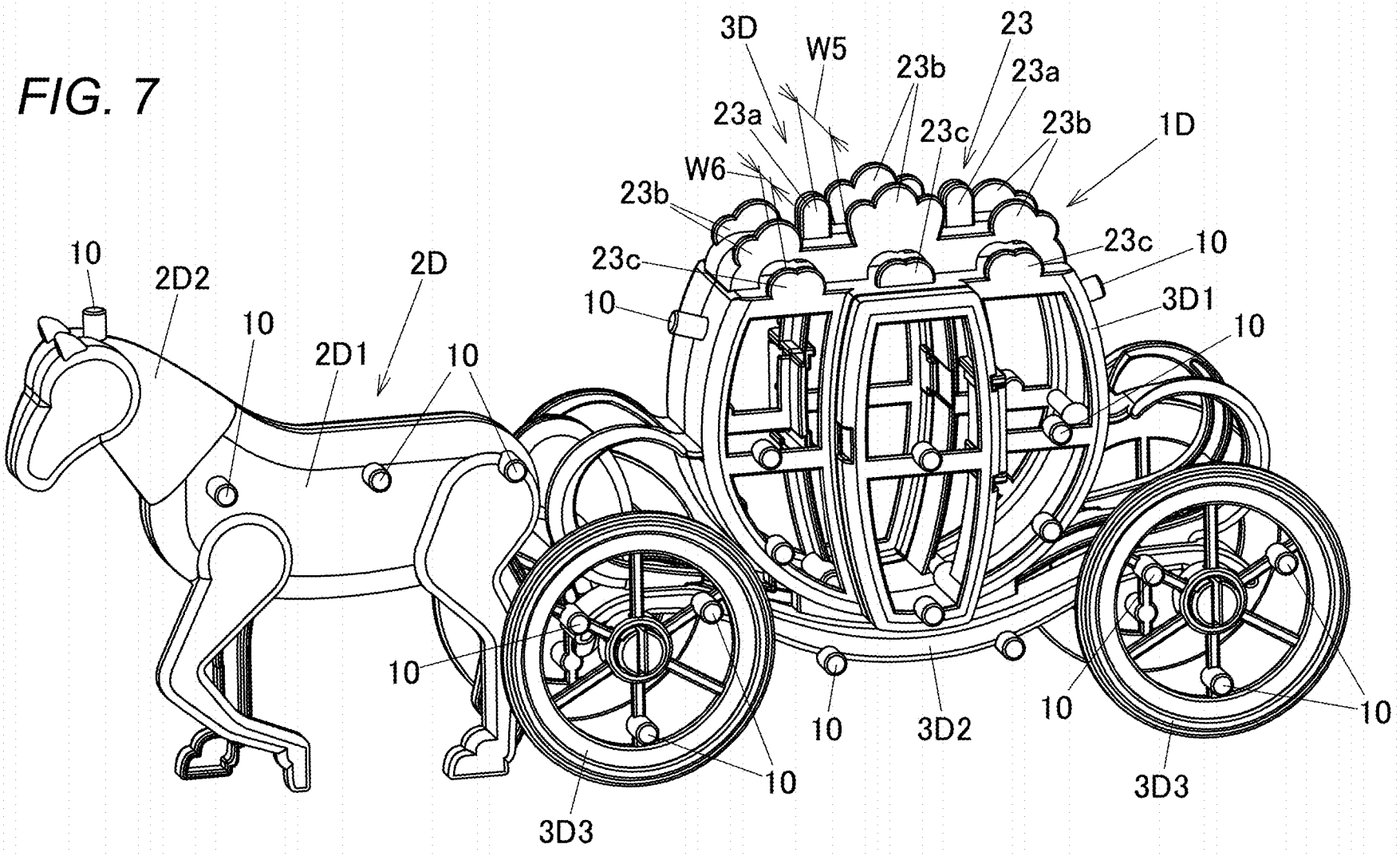
FIG. 7 is a perspective view showing a decorative toy for fusible toy bead imitating a carriage and a horse pulling the carriage according to the embodiment of the present invention.

Next, a decorative toy 1D for fusible toy bead imitating a vehicle as a carriage and a horse pulling the carriage is shown in FIG. 7. The decorative toy 1D is provided with a horse portion 2D imitating a horse pulling a carriage and a carriage portion 3D. On the horse portion 2D, a plurality of bead engagement portions 10 similar to the above-described ones are formed on a body portion 2D1. The bead engagement portions 10 on the body portion 2D1 are disposed so as to be symmetrical on both surfaces. Moreover, the bead engagement portions 10 in the shape of a cylindrical protrusion are also formed on the head top portion of a head portion 2D2 of the horse portion 2D.

On the other hand, the carriage portion 3D of the decorative toy 1D is provided with a compartment portion 3D1, a chassis portion 3D2 and four wheel portions 3D3. The compartment portion 3D1, the chassis portion 3D2 and the wheel portions 3D3 are each provided with a plurality of bead engagement portions 10 in the shape of the cylindrical protrusion. On the top surface of the compartment portion 3D1, a groove-form bead engagement portion 23 is formed. On the bead engagement portion 23, the following are formed: plate-like members 23*a* disposed in two positions in the center; three plate-like members 23*b* disposed at predetermined intervals on each of the side surface sides so as to be symmetrical with respect to the plate-like members 23*a*; and three plate-like members 23*c* disposed at predetermined intervals further on each of the side surface sides so as to be symmetrical with respect to the plate-like members 23*b*. The plate-like members 23*a* and the plate-like members 23*b* are formed on a one step higher stage on the top surface of the compartment portion 3D1, and the plate-like members 23*c* are formed on the lower stage. The plate-like members 23*b* are formed so that the height from the surface where the plate-like members 23*c* are formed is larger than the height of the plate-like members 23*c*. Similarly to the above description, the interval formed by the plate-like members 23*a* and the plate-like members 23*b* (the width dimension W5 which is the groove width) and the interval formed by the plate-like members 23*b* and the plate-like members 23*c* (the width dimension W6 which is the groove width) are formed so as to be substantially the same as the maximum dimension D in accordance with the maximum dimension D of the fusible toy bead 100 shown in FIGS. 2A and 2B.

Figure 8:
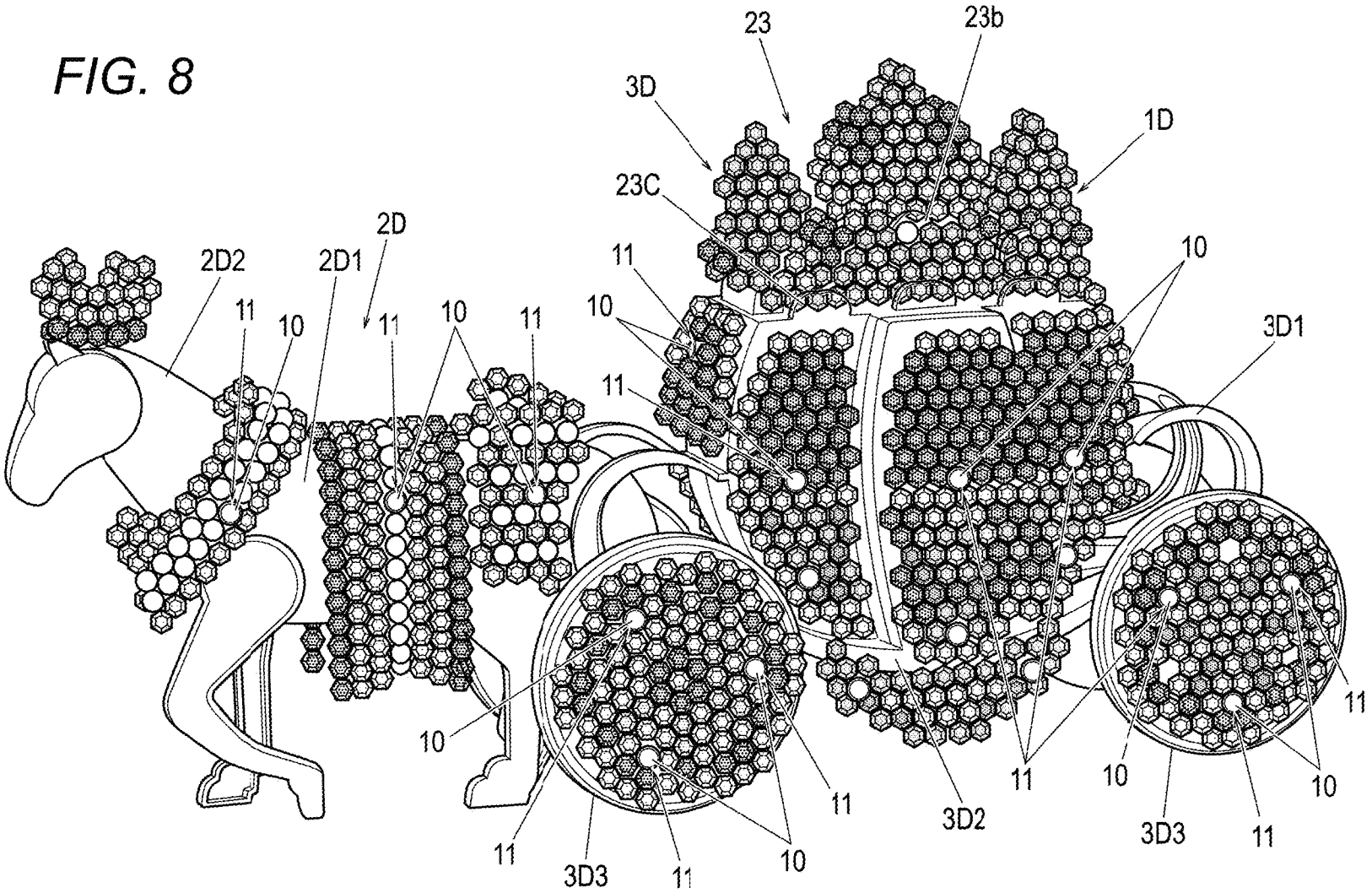
FIG. 8 is a view showing an example in which aggregations of the fusible toy beads are attached to the decorative toy for fusible toy bead imitating a carriage and a house pulling the carriage according to the embodiment of the present invention.

An example of attachment of aggregations of the fusible toy beads 100 to the decorative toy 1D is shown in FIG. 8. Similarly to the above description, aggregations of the fusible toy beads 100 formed in the shape of a plane so as to have void portions 11 each coinciding with one fusible toy bead 100 can be attached to the decorative toy 1D by engaging them with the protrusion-form bead engagement portions 10. Moreover, aggregations of the fusible toy beads 100 formed in the shape of a plane can be attached to the decorative toy 1D by inserting them into the groove-form bead engagement portion 23.

Figure 9:
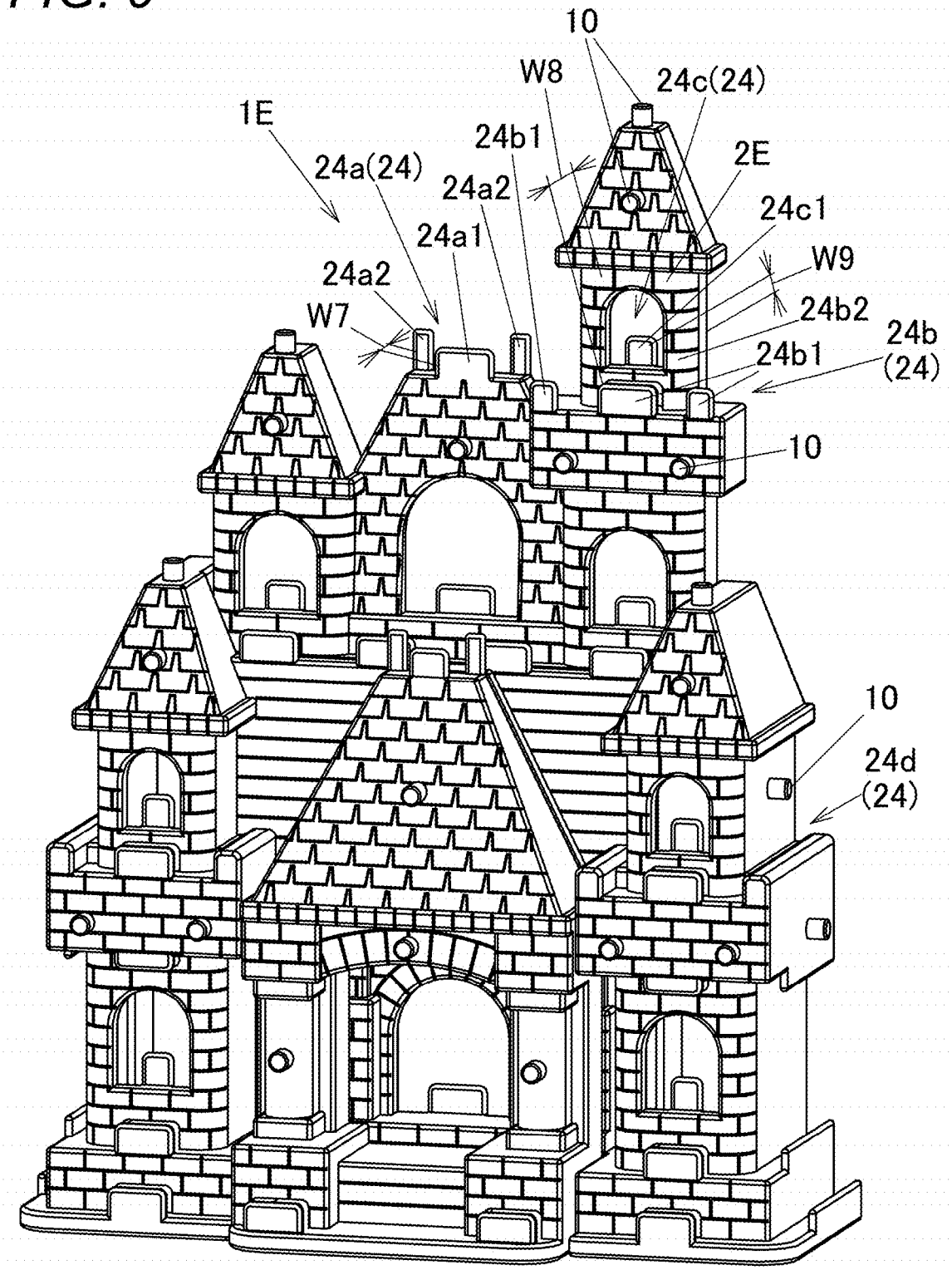
FIG. 9 is a perspective view showing a decorative toy for fusible toy bead imitating a building according to the embodiment of the present invention.

Next, a decorative toy 1E for fusible toy bead imitating a castle as a building is shown in FIG. 9. On the front surface and side surfaces of the decorative toy 1E and at the top of each roof, a plurality of bead engagement portions 10 in the shape of a cylindrical protrusion are formed. Moreover, on the decorative toy 1E, a plurality of groove-form bead engagement portions 24 formed in the shape of a groove and provided with plate-like members are formed. For example, a bead engagement portion 24*a* formed in an upper part of the decorative toy 1E is provided with a plate-like member 24*a*1 on the front side and plate-like members 24*a*2 on the rear side. The plate-like member 24*a*1 and the plate-like members 24*a*2 are disposed so as to be offset. The bead engagement portion 24*a* is formed in the shape of a groove by the plate-like member 24*a*1 and the plate-like members 24*a*2, and the surface where the plate-like member 24*a*1 and the plate-like members 24*a*2 are provided (bottom surface). The distance (groove width) between the plate-like member 24*a*1 and the plate-like members 24*a*2 is made the width dimension W7, and similarly to the above description, are made substantially the same as the maximum dimension D in accordance with the maximum dimension D of the fusible toy bead 100 shown in FIGS. 2A and 2B.

On the other hand, a bead engagement portion 24*b* provided in an upper part on the viewer's right of the decorative toy 1E is formed in the shape of a groove by three plate-like members 24*b*1 on the front side, a front surface 24*b*2 which is the wall surface of an independent portion 2E of the building of the decorative toy 1E and as the bottom surface, the surface where the plate-like members 24*b*1 is provided. The width dimension W8 which is the groove width is similarly formed so as to be substantially the same as the maximum dimension D in accordance with the maximum dimension D of the fusible toy bead 100 shown in FIGS. 2A and 2B. Moreover, behind the bead engagement portion 24*b*, a bead engagement portion 24*c* is formed. The bead engagement portion 24*c* is formed in the shape of a groove where a plate-like member 24*c*1 facing the window portion of the independent portion 2E is the rear side, a rear surface 24*c*2 of the independent portion 2E is the front side and the lower edge surface of the window portion where a plate-like member 24*c*1 is provided is the bottom surface. The width dimension W9 which is the groove width is similarly formed substantially the same as the maximum dimension D in accordance with the maximum dimension D of the fusible toy bead 100 shown in FIGS. 2A and 2B. Further, a groove-form bead engagement portion 24*d* is also formed on the side surface of the decorative toy 1E.

Figure 10:
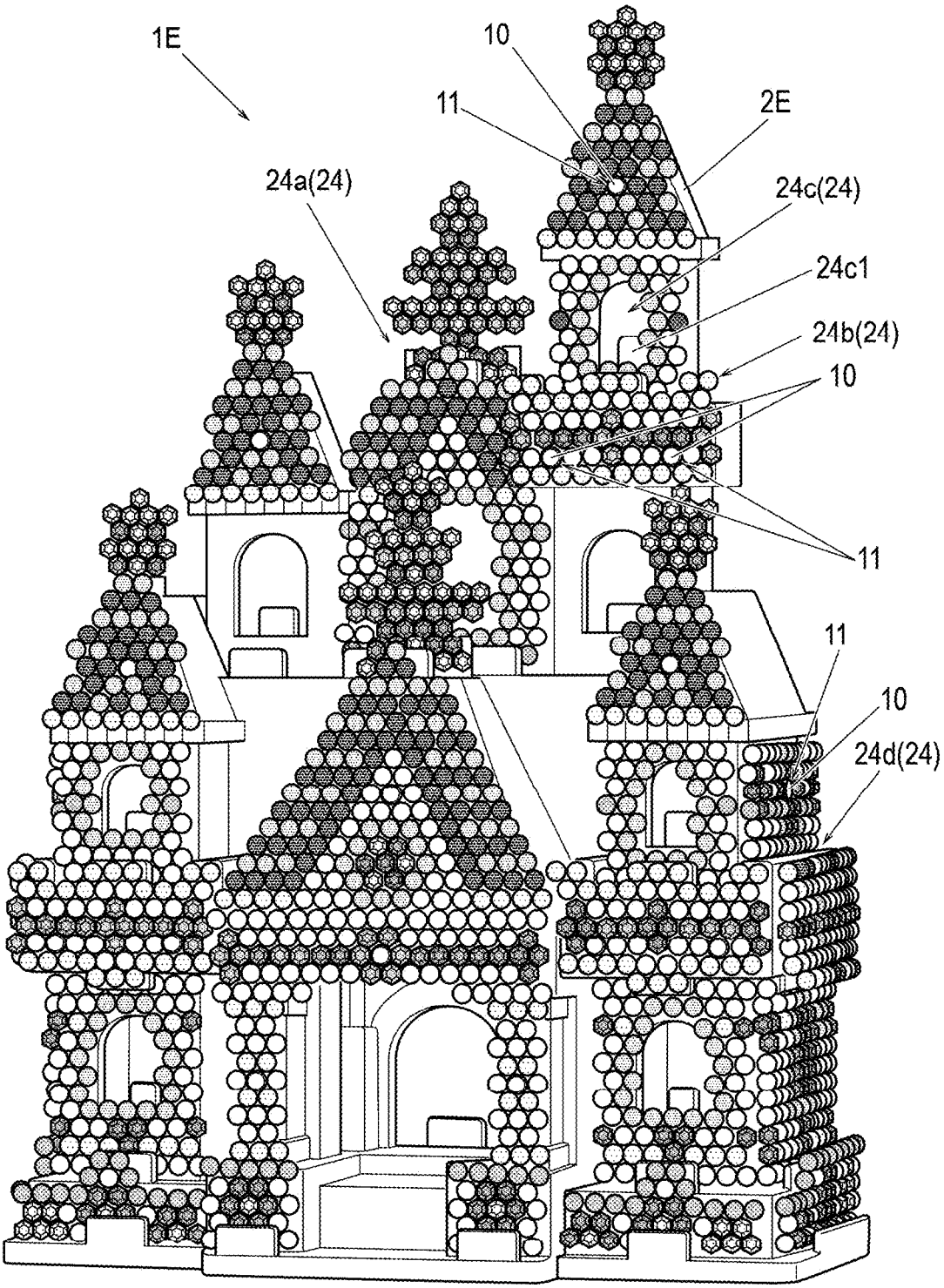
FIG. 10 is a perspective view showing an example in which aggregations of the fusible toy beads are attached to the decorative toy for fusible toy bead imitating a building according to the present embodiment.

An example of attachment of aggregations of the fusible toy beads 100 to the decorative toy 1E is shown in FIG. 10. Similarly to the above description, aggregations of the fusible toy beads 100 formed in the shape of a plane so as to have void portions 11 each coinciding with one fusible toy bead 100 can be attached to the decorative toy 1E by engaging them with the protrusion-form bead engagement portions 10. Moreover, aggregations of the fusible toy beads 100 formed in the shape of a plane can be attached to the decorative toy 1E by inserting them into the groove-form bead engagement portions 24.

According to the above-described embodiment of the present invention, a decorative toy for fusible toy bead and a fusible toy bead set of the following modes can be provided:

A decorative toy for fusible toy bead according to a first aspect includes: a bead engagement portion including a protrusion, a groove or a hole having a width dimension which is set in accordance with a maximum dimension of fusible toy beads, and configured to be engageable with an aggregation of the fusible toy beads.

According to this structure, when the aggregation of fusible toy beads has a void portion and the bead engagement portion of the decorative toy for fusible toy bead has a protrusion, the void portion can be easily fitted to the protrusion. Moreover, the aggregation of fusible toy beads formed in the shape of a plane can be easily fitted to the groove or the hole of the bead engagement portion of the decorative toy for fusible toy bead. Consequently, it is possible to provide a decorative toy for fusible toy bead where the aggregation of fusible toy beads can be repetitively attached and detached even by small children.

In a decorative toy for fusible toy bead according to a second aspect, the bead engagement portion includes a cylindrical protrusion having a height dimension set in accordance with the maximum dimension of the fusible toy bead.

According to this structure, even if the protrusion of the bead engagement portion is inserted into the void portion of the decorative toy for fusible toy bead, since the cylindrical protrusion of the bead engagement portion which is circular in a front view and a spherical or polyhedral fusible toy bead are substantially the same in size, the protrusion of the bead engagement portion can be made inconspicuous after the fusible toy beads are attached to the decorative toy.

In a decorative toy for fusible toy bead according to a third aspect, the groove of the bead engagement portion is defined by two plate-like members disposed so as to face each other, and heights of the two plate-like members are different from each other.

According to this structure, since it is possible that of the two plate-like members, for example, the plate-like member on the front side be made small in height and the plate-like member on the rear side be made large in height, the decorative toy to which the aggregation of fusible toy beads is attached can be made to look nice by reducing the area where the aggregation of fusible toy beads is hidden by the plate-like members, and the aggregation of fusible toy beads can be surely supported.

In a decorative toy for fusible toy bead according to a fourth aspect, the hole of the bead engagement portion is rectangle.

According to this structure, the decorative toy to which the aggregation of fusible toy beads is attached can be made to look nice by reducing the gap between the fusible toy beads inserted into the hole-form bead engagement portion and the bead engagement portion.

A fusible toy bead set according to a fifth aspect includes: a plurality of fusible toy beads and the decorative toy for fusible toy bead according to any of the first to fourth aspects.

According to this structure, it is possible to provide a fusible toy bead provided with the decorative toy for fusible toy bead that can be played with by attaching the created aggregation of fusible toy beads.

While an embodiment of the present invention has been described above, the present invention is not limited to the above-described embodiment, and may be modified variously without departing from the scope of the present invention. For example, the following may be performed: Aggregations of the fusible toy beads are three-dimensionally formed by laminating aggregations of the fusible toy beads formed in the shape of a plane, and these three-dimensionally formed aggregations of the fusible toy beads are attached to the bead engagement portions.

The invention claimed is:

1. A decorative toy for use with fusible toy beads comprising:

a bead engagement portion comprising a protrusion, a groove, or a hole, wherein each protrusion, groove, or hole is engageable with an aggregation of multiple fusible toy beads, and wherein each protrusion, groove, or hole has a width dimension which is set in accordance with a maximum dimension of at least one of the fusible toy beads, and wherein the bead engagement portion comprises a cylindrical protrusion having a height dimension set in accordance with the maximum dimension of the fusible toy bead.

2. The decorative toy according to claim 1, wherein the groove of the bead engagement portion is defined by two plate-like members disposed so as to face each other, and heights of the two plate-like members are different from each other.

3. The decorative toy according to claim 1, wherein the hole of the bead engagement portion is rectangle.

4. A fusible toy bead set comprising:

a plurality of fusible toy beads; and the decorative toy according to claim 1.

5. A decorative toy for use with fusible toy beads comprising:

a bead engagement portion comprising a protrusion, a groove, or a hole, wherein each protrusion, groove, or hole is engageable with an aggregation of multiple fusible toy beads, and wherein each protrusion, groove, or hole has a width dimension which is set in accordance with a maximum dimension of at least one of the fusible toy beads, and wherein the groove of the bead engagement portion is defined by two plate-like members disposed so as to face each other, and heights of the two plate-like members are different from each other.

6. The decorative toy according to claim 5, wherein the hole of the bead engagement portion is rectangle.

7. A fusible toy bead set comprising:

a plurality of fusible toy beads; and the decorative toy according to claim 5.

* * * * *